US006883527B2

(12) United States Patent
Travaly et al.

(10) Patent No.: US 6,883,527 B2
(45) Date of Patent: Apr. 26, 2005

(54) METHOD FOR ROBOTICALLY CLEANING COMPRESSOR BLADING OF A TURBINE

(75) Inventors: Andrew Joseph Travaly, Ballston Spa, NY (US); William Francis Lopes, Groton, MA (US); Kathleen Lynne Bentzel, Latham, NY (US)

(73) Assignee: General Electric Company, Schenectady, NY (US)

( * ) Notice: Subject to any disclaimer, the term of this patent is extended or adjusted under 35 U.S.C. 154(b) by 248 days.

(21) Appl. No.: 10/201,649

(22) Filed: Jul. 24, 2002

(65) Prior Publication Data

US 2004/0016449 A1 Jan. 29, 2004

(51) Int. Cl.[7] ..... B08B 9/00

(52) U.S. Cl. ..... 134/22.18; 134/6; 134/8; 134/22.1; 134/24; 134/34; 134/42; 134/169 R; 15/104.09; 15/104.095; 15/104.16; 15/104.05; 15/211; 15/301; 15/302; 15/304; 15/312.1; 15/312.2; 15/316.1; 15/406

(58) Field of Search ..... 15/104.16, 104.095, 15/104.09, 104.05, 211, 304, 301, 302, 312.1, 312.2, 316.1, 406; 134/6, 8, 22.1, 22.18, 24, 34, 42, 169 R

(56) References Cited

U.S. PATENT DOCUMENTS 4,046,155 A * 9/1977 Mansson ..... 134/167 R
4,548,040 A * 10/1985 Miller et al. ..... 60/619
5,938,402 A * 8/1999 Bochud et al. ..... 415/417
5,944,483 A * 8/1999 Beck et al. ..... 415/117
6,073,637 A * 6/2000 Hayward et al. ..... 134/22.1
6,310,022 B1 * 10/2001 Amiran ..... 510/185
6,503,334 B1 * 1/2003 Ruiz et al. ..... 134/18
2002/0141882 A1 * 10/2002 Ingistov et al. ..... 417/244
2004/0016449 A1 * 1/2004 Travaly et al. ..... 134/22.18

OTHER PUBLICATIONS

How Things Fly: Roll, Pitch, and Yaw, Sep. 18, 1996, p. 1.*

* cited by examiner

*Primary Examiner*—Sharidan Carrillo
(74) *Attorney, Agent, or Firm*—Nixon & Vanderhye

(57) ABSTRACT

The compressor cleaning system includes a track mounted about the inlet of the compressor. A circumferential position assembly mounts an insertion drive assembly which is driven about the track into selected circumferential positions. The insertion drive assembly carries a manipulator arm assembly mounting at its distal end a cleaning head. By using pairs of control cables, the proximal yaw, pitch and distal yaw sections of the manipulator arm can be moved to weave the cleaning head past the multiple stages of blading to locate the cleaning head adjacent a selected blade. By repeated extension and retraction of the cleaning head relative to the compressor inlet and about the compressor blades, each blade can be cleaned without disassembly of the compressor casing or removal of the rotor.

11 Claims, 14 Drawing Sheets

METHOD FOR ROBOTICALLY CLEANING COMPRESSOR BLADING OF A TURBINE

BACKGROUND OF THE INVENTION

The present invention is directed to apparatus for cleaning the compressor blades of a turbine and particularly relates to apparatus for robotic washing of the compressor blading of a plurality of compressor stages by accessing the blading through the compressor inlet and without disassembly of the compressor casings or removal of the compressor rotor.

Turbines, for example, gas turbines, undergo changes in performance over time. Fundamentally, losses in the compressor and turbine are caused by a deterioration of blade and casing surface finishes, blade shape profile changes, rubs and other flow path distortions. Power and efficiency are reduced as a result of these frictional and aerodynamic changes. The majority of the aggregate losses are attributable to the compressor.

Turbine performance can be recovered to varying degrees by compressor washing processes designed to remove fouling and-deposition on the compressor blading. Current practices include water-washing the compressor blading in either an online or offline configuration. For example, an online wash is the process of injecting water into the compressor while the turbine is running at full speed and some percentage of load. Offline washing is the process of injecting a cleaning solution into the compressor while it is being turned at cranking speed. While these processes are generally effective, there are still residual losses after cleaning. For example, the advantage of the offline cleaning process is its ability to break down less water-soluble, oily deposits, but neither process restores compressor performance to the level of a hand-scour, which can be attained only during a major outage and disassembly of the compressor. Consequently, at present, these residual losses are addressed only by removal of casings and aggressive restoration work or parts replacement, all of which are costly. Accordingly, there is a need for a more effective cleaning process which would substantially restore the efficiency of the compressor blading to nearly its original efficiency during outages but without disassembly of the turbine in order to maximize recovery of turbine losses over time and provide the equivalent extension of part lives.

BRIEF DESCRIPTION OF THE INVENTION

In accordance with a preferred embodiment of the present invention, there is provided a robotic system for cleaning compressor blading of various stages of the compressor utilizing a spray head at controlled cleaning locations within the stages of the compressor blading in combination with robotic manipulation of the spray head through the complex compressor geometry, enabling blade contour following that will permit cleaning of areas of blades traditionally inaccessible, absent removal of the compressor casing. Further, the compressor cleaning apparatus of the present invention enables performance of the cleaning process remotely from the compressor bell mouth inlet while the turbine is shut down and remains fully assembled. Consequently, the cleaning apparatus is designed for use at normal turbine shutdown or maintenance intervals such that the performance gains are optimally sustained throughout the turbine life cycle. In comparison with offline compressor water wash processes, the present invention affords about a 1% increment in output improvement.

More particularly, the compressor blade cleaning apparatus includes a number of subsystems: a track assembly; a circumferential position drive assembly; an insertion drive assembly including a deployment chain assembly; a manipulator arm assembly; and a cleaning head. The track assembly includes a plurality of arcuate segments which are releasably attached to the steerable vanes of the compressor inlet and provide an annular track about the compressor inlet. The circumferential position drive assembly is mounted on the track assembly and drives the insertion drive and manipulator arm assemblies, together with the cleaning head, to selected circumferential positions about the compressor inlet. The insertion drive assembly is carried by the circumferential position drive assembly for circumferential movement therewith. The insertion drive assembly includes a deployment chain which can be extended from and retracted within the insertion drive assembly. The distal end of the chain mounts the manipulator arm assembly which also carries the cleaning head at its distal end. The manipulator arm assembly comprises a proximal yaw section, a pitch section and a distal yaw section. Each of these sections includes a plurality of spaced plates separated by compliant material enabling the sections to weave between the compressor blading to locate the cleaning head adjacent a selected compressor blade. The cleaning head thus moves in two generally right angularly related directions and is thus positionable within the various stages adjacent the selected compressor blade. The cleaning head includes a plurality of washing nozzles, as well as a camera and lights to assist in manipulating the arm for passage through the blading of the stages to the selected blade. A washing fluid is passed through the manipulator arm and the nozzles of the cleaning head scour the selected blade. The process is repeated for each blade. It will be appreciated that the compressor need not be disassembled or have its rotor removed to effect the cleaning process.

In a preferred embodiment according to the present invention, there is provided a method for cleaning compressor blades in situ, comprising (a) inserting a cleaning head into a compressor through an inlet end thereof at a predetermined circumferential location about the compressor inlet to locate the cleaning head adjacent of one of a plurality of rotatable blades of the compressor, (b) manipulating the cleaning head in pitch and yaw directions while inserting the cleaning head to locate the cleaning head in the compressor blades past first stage stator blades and (c) actuating the cleaning head to clean the one rotatable blade of the compressor.

In a further preferred embodiment according to the present invention, there is provided a method for cleaning compressor blades in situ, comprising (a) providing an insertion assembly having a manipulator arm mounting a cleaning head on a distal end thereof, (b) inserting the manipulator arm into a compressor through an inlet end thereof at a predetermined circumferential location about the compressor inlet, (c) manipulating the arm in pitch and yaw directions while inserting the arm to locate the cleaning head in the compressor blades past first stage blades thereof and (c) actuating the cleaning head to clean at least one compressor blade of the compressor.

DETAILED DESCRIPTION OF THE INVENTION

Figure 1:
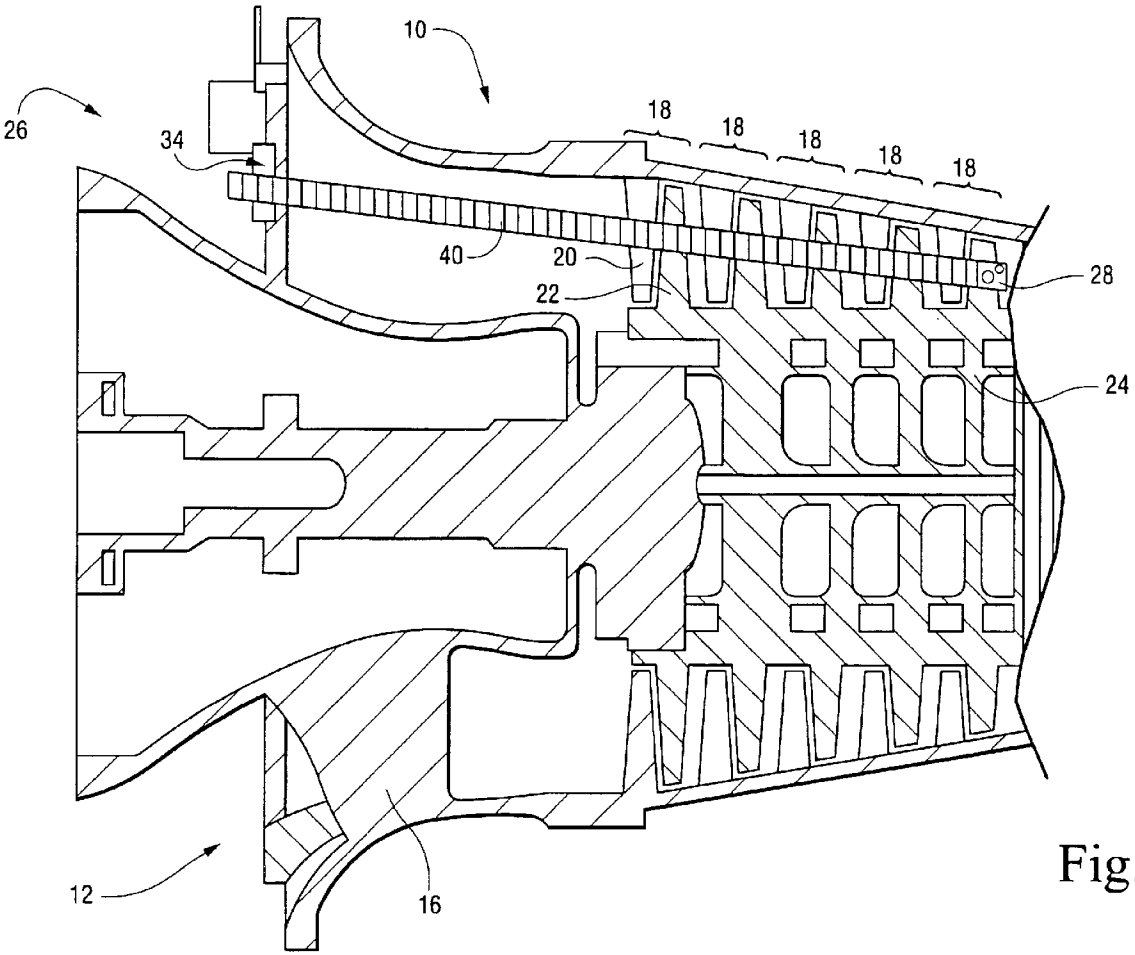
FIG. 1 is a fragmentary schematic cross-sectional view through the axis of a compressor illustrating the various stages of the compressor blading, the compressor inlet and a compressor cleaning system in operable position for cleaning a selected blade of the compressor blading.

Referring now to FIG. 1, there is illustrated a portion of a compressor, generally designated 10, having an inlet 12 in the shape of a bell mouth 14, a single steerable vane 16 of a plurality of circumferentially spaced steerable vanes being illustrated in the bell mouth 14. A number of stages 18 are illustrated with each stage including non-rotatable circumferentially spaced stator blades 20 extending generally radially inwardly from the compressor casing and a plurality of circumferentially spaced blades 22 mounted on the rotor 24. It will be appreciated that the rotational position of the rotor blades vis-a-vis the position of the stator blades during an outage is random.

Also illustrated in FIG. 1 is a compressor blade cleaning system, generally designated 26. The system 26 is mounted adjacent the inlet 12 and includes a cleaning head 28 positioned adjacent a selected blade among the blades of the various stages for applying a cleaning fluid to the selected blade. As illustrated, the cleaning head is projected into the stages from the inlet 12 about which the system 26 is mounted. The cleaning head is thus capable of being extended through the randomly disposed stator and rotor blading for location adjacent the selected blade and retracted from the various stages for insertion, again through multiple stages of blading, to lie adjacent another selected blade. In a preferred embodiment, the cleaning head may be extended through five stages of compressor blading to clean the rotor blades 22 of the fifth stage of the compressor. It will be appreciated that the blades of the stages preceding the fifth stage, as well as blades beyond the fifth stage, may be cleaned, depending upon the nature of the compressor and cleaning system.

Figure 2:
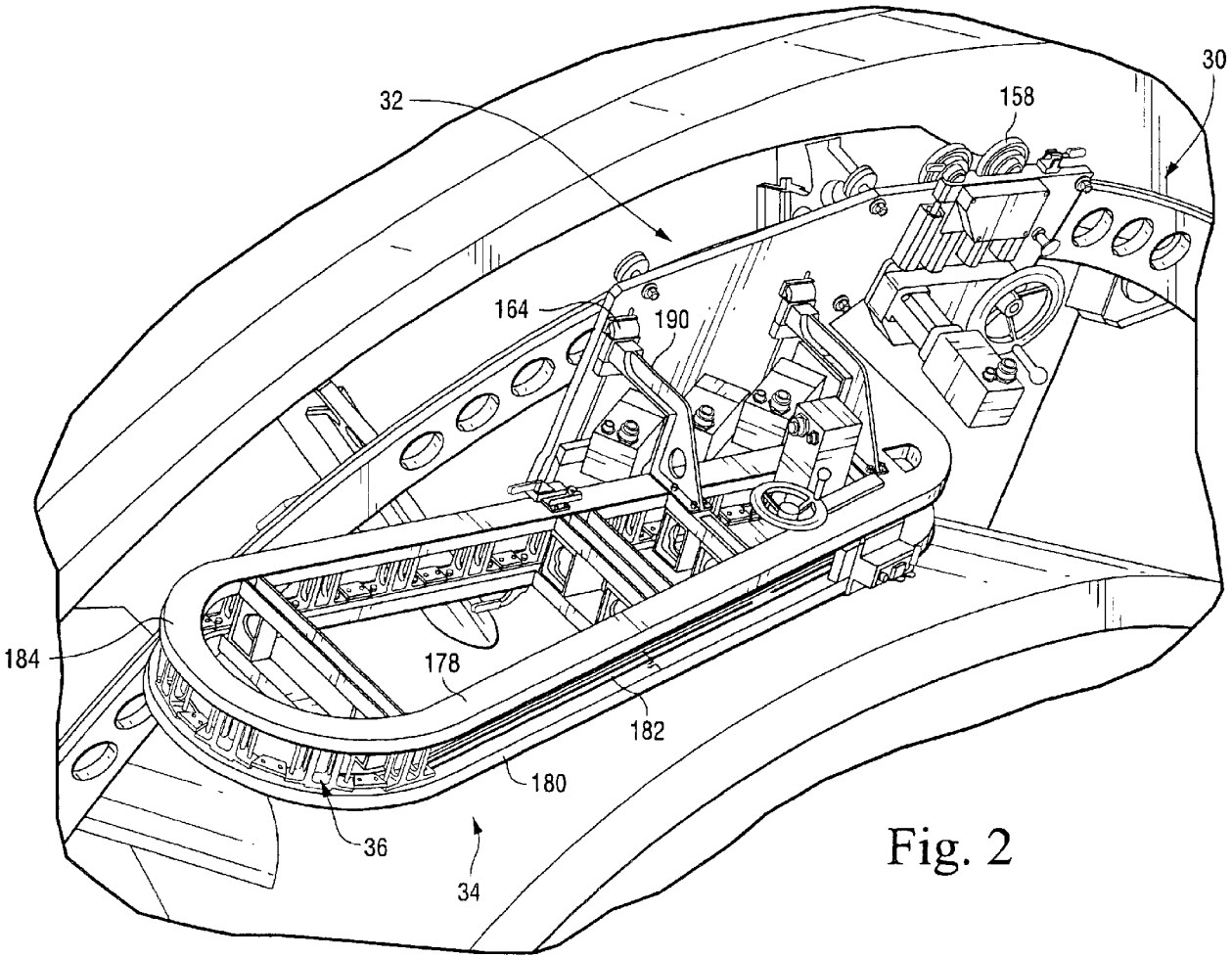
FIG. 2 is a fragmentary enlarged perspective view illustrating portions of the track, circumferential position and insertion drive assemblies.
Figure 11:
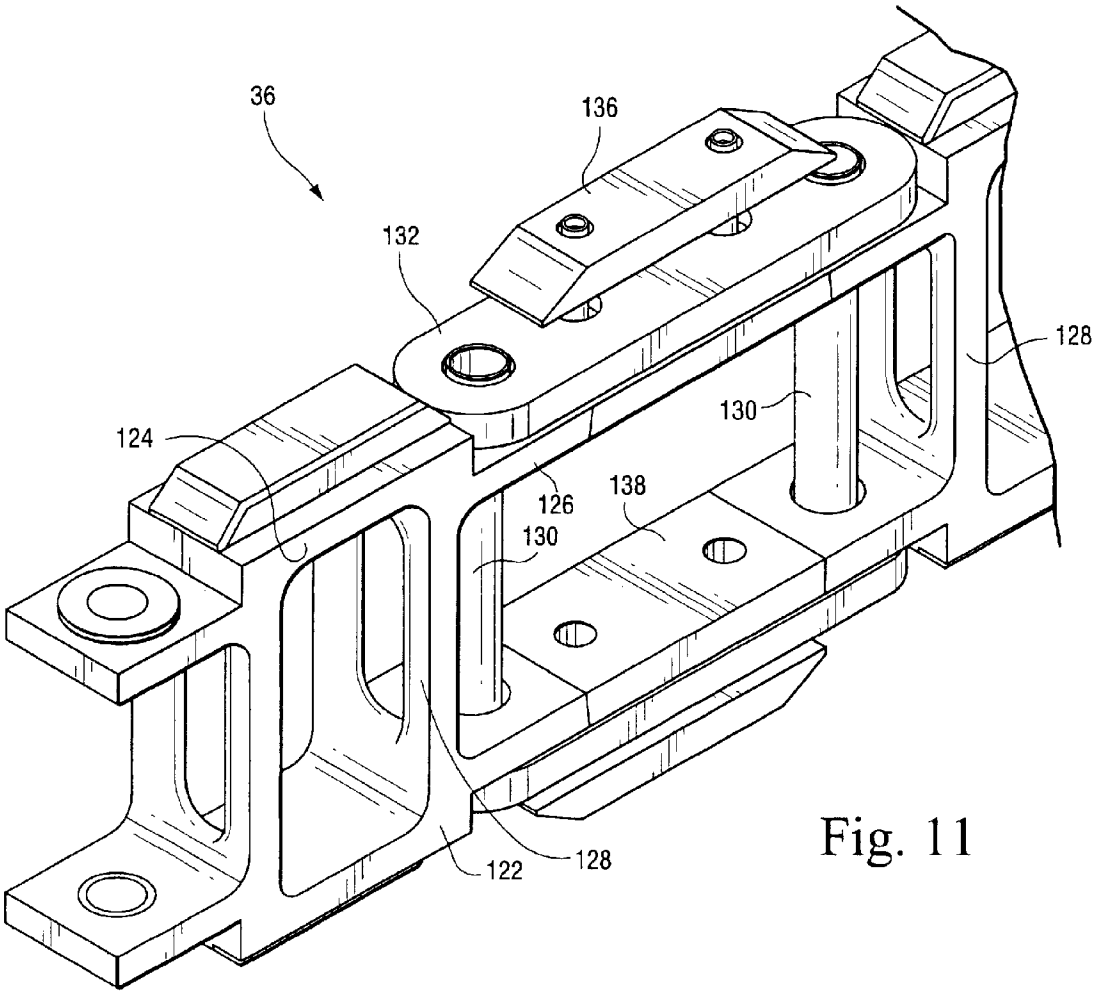
FIG. 11 is a perspective view of a portion of a deployment chain in a locked beam position.
Figure 19:
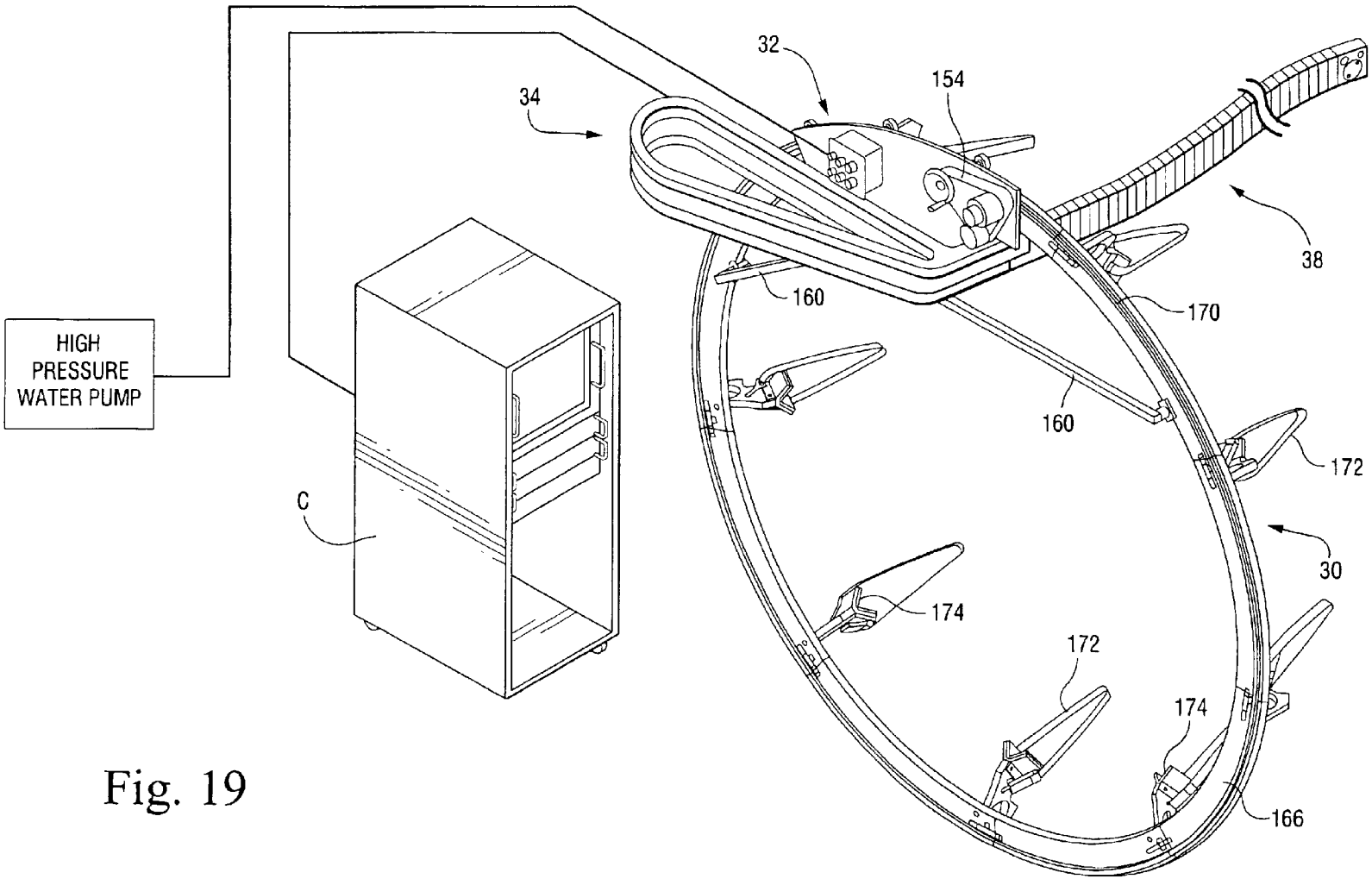
FIG. 19 is a schematic illustration of the compressor cleaning system hereof.

Referring now to FIG. 2, various assemblies of the cleaning system 26 are, at least in part, illustrated. Referring particularly to FIGS. 2 and 19, there is provided a track assembly, generally designated 30, for mounting the cleaning system adjacent the inlet 12 of the compressor 10. The track assembly, as described in detail hereinafter, is comprised of a plurality of arcuate segments assembled to form an annular track and is secured to the compressor inlet, particularly to the steering vanes 16. A circumferential position drive assembly, generally designated 32, is mounted on the track assembly 30 for circumferential movement about the track assembly 30 into selected circumferential positions. The circumferential position drive assembly thus locates the cleaning head 28 circumferentially about the blading. Mounted on the circumferential position drive assembly 32 is an insertion drive assembly, generally designated 34. Insertion drive assembly 34 includes a deployment assembly including a deployment chain, generally designated 36 (see FIGS. 2, 11 and 12) which is guided about the insertion drive assembly and mounts at a distal end a manipulator arm assembly, generally designated 38 (see FIG. 19). The distal end of the manipulator arm assembly mounts the cleaning head 28. As noted previously, the cleaning head 28 is positioned adjacent a selected blade of the various stages and carries nozzles for flowing a cleaning fluid onto the selected blading to clean the blading. To accomplish this, the system enables the cleaning head to be inserted between and among the blades of the various stages such that the cleaning head lies adjacent the selected blade, for example, in the plane of rotation of a selected rotor blade of the fifth stage of the compressor. Once the cleaning is accomplished, the cleaning head may be withdrawn or partially withdrawn to clean selected blades of other stages or the stator blades of the fifth stage. Ultimately, however, the cleaning head must be withdrawn from between the bladings of the various stages and reinserted at the mouth of the compressor at another circumferential position about the compressor for location adjacent another selected blade or blades. Consequently, it will be appreciated that the manipulator arm assembly 38 is extended and retracted relative to the blading by the insertion drive assembly and located at selected circumferential positions by the circumferential position drive assembly 32. Because the circumferential position drive assembly 32 is movable through 360° to selected positions about the rotor axis, it will be appreciated that each of the blades of the various stages may be cleaned by locating the cleaning head 28 adjacent the selected blade. The various assemblies will now be described in detail.

Manipulator Arm Assembly

Figure 3:
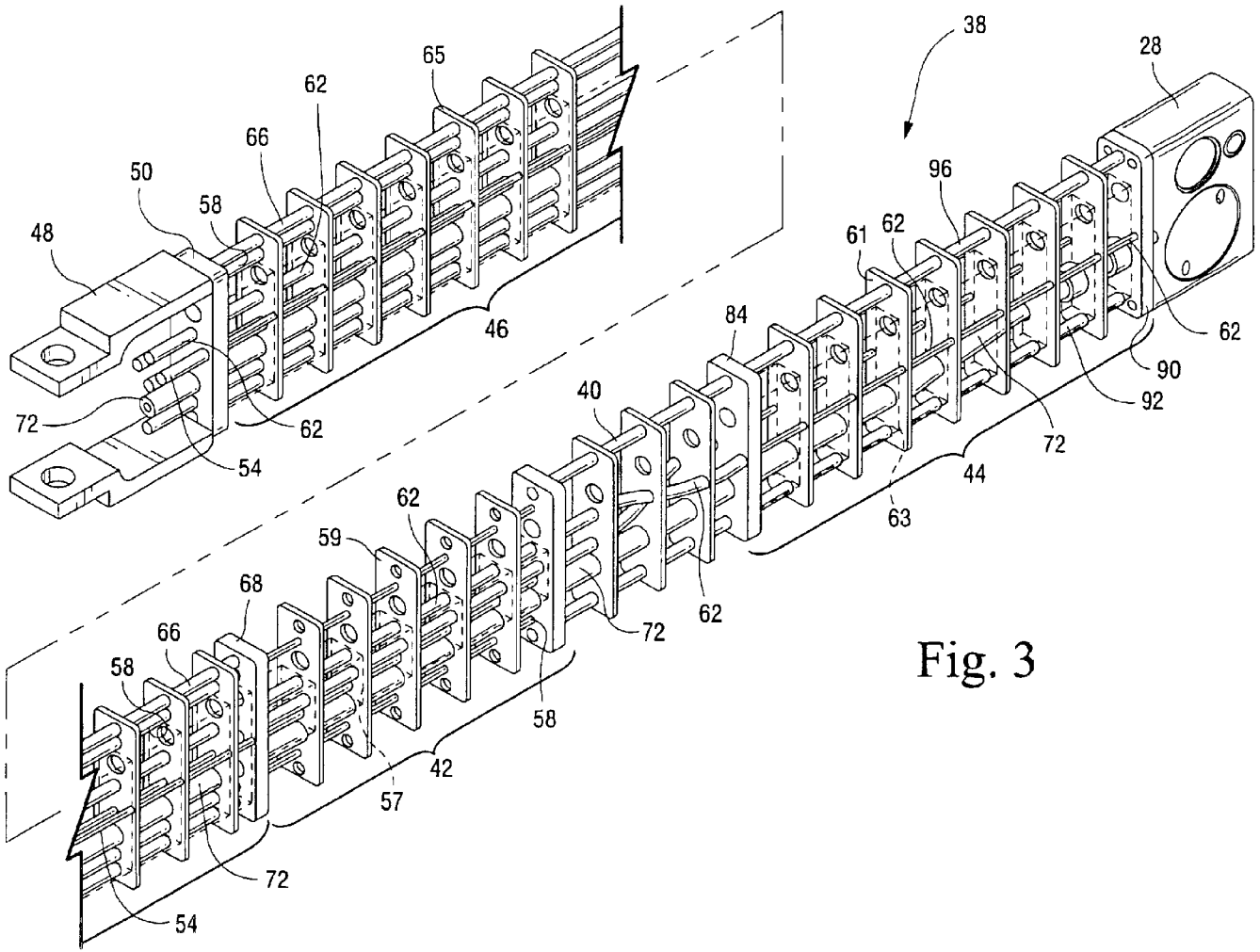
FIG. 3 is a perspective view with parts broken out for ease of illustration of the manipulator arm assembly.

Referring now to FIG. 3, the manipulator arm assembly 38 is provided in the form of a structural skeleton comprised of a plurality of plates spaced from and generally perpendicular to one another in a lengthwise direction of the manipulator arm 40 and formed in a plurality of sections, namely: a pitch section 42, a distal yaw section 44 and a proximal yaw section 46. The various plates comprising the arm 40 are generally rectilinear and have various openings or holes to conduct necessary cabling and hoses as described below. Note in FIG. 3 that the cleaning head 28 is mounted on the distal end of the distal yaw section 44. Also, at the opposite end of the manipulator arm assembly 38, a connecting link 48 couples the manipulator arm assembly 38 to the distal end of the deployment chain 36. The pitch section 42 provides for movement of the cleaning head 28 in a direction generally corresponding to the long axis of each of the plates forming the manipulator arm assembly, i.e., in a generally radial direction relative to the compressor rotor axis when the cleaning system is in use. The distal and proximal yaw sections 44 and 46, respectively, provide for movement of the manipulator arm assembly in directions generally right angularly related to the direction of movement of the pitch section, i.e., a generally tangential direction relative to the compressor axis when the cleaning system is installed and used. The flexibility of the proximal and distal yaw sections are different from one another to provide a greater flexibility and smaller radius of turn in the distal yaw section than in the proximal yaw section. The pitch section has a different flexibility due to the rectilinear cross-section of the manipulator arm 40. Both the proximal yaw and pitch sections may flex up to 60° in a preferred embodiment hereof.

Figure 4:
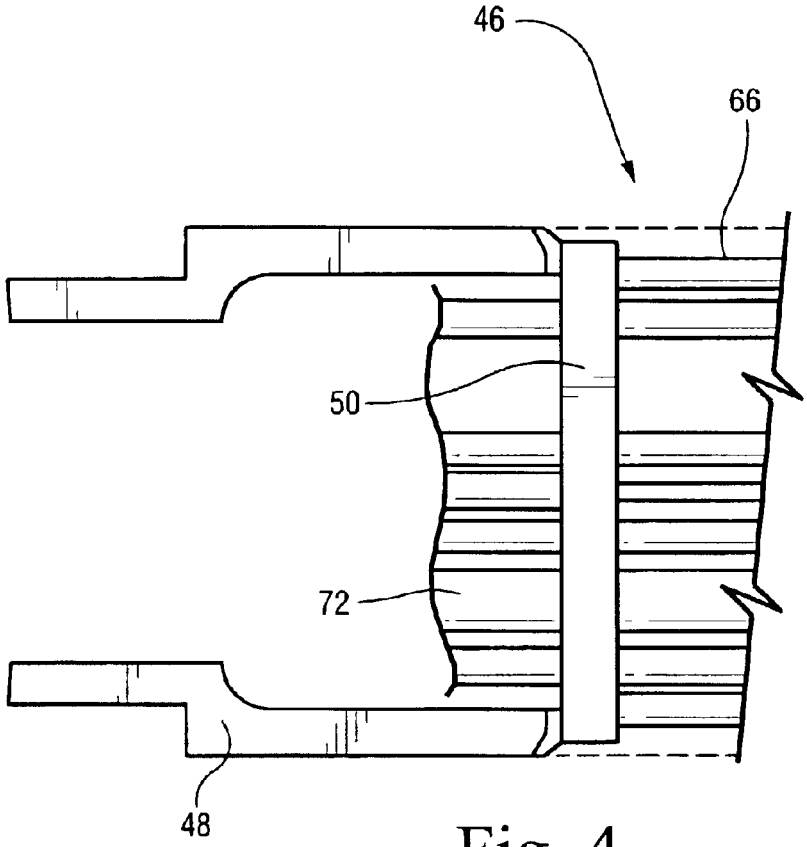
FIG. 4 is an enlarged side elevational view of the proximal end of the manipulator arm assembly.
Figure 5:
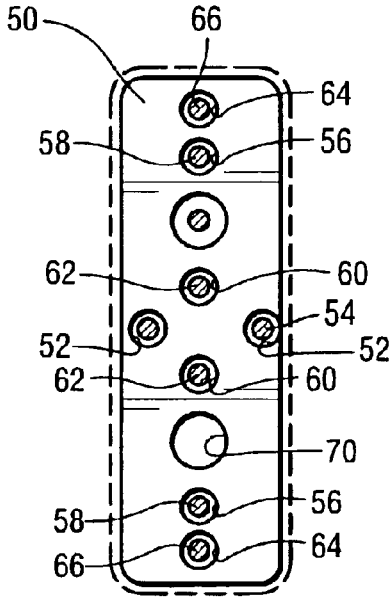
FIG. 5 is a cross-sectional view of the end plate of the manipulator arm end illustrated in FIG. 4.
Figure 9:
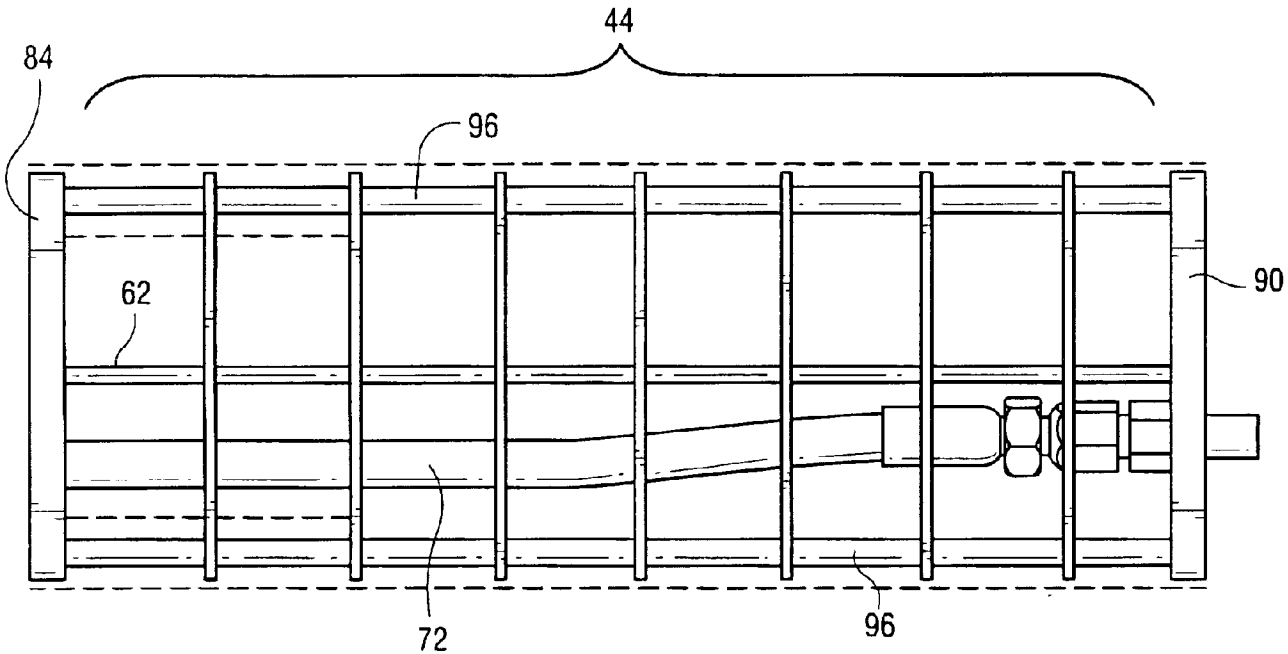
FIG. 9 is a side elevational view of the distal yaw section of the manipulator arm hereof.

As best illustrated in FIGS. 4 and 5, the proximal end of the proximal yaw section 46 includes a plate 50 having various openings. From a review of FIG. 3, it will be appreciated that not only are electrical and fluid lines provided through the various plates forming the manipulator arm for connection to the cleaning head 28, but also control elements, e.g., cables, are provided to control the movements of the proximal yaw, pitch and distal yaw sections 46, 42 and 44, respectively. To provide for this cabling, the proximal end plate 50 of the proximal yaw section includes openings 52 along opposite sides of plate 50 for receiving cables 54 for controlling the proximal yaw section 46 for movement in the yaw direction. Openings 56 are provided adjacent opposite ends of the plate 50 for receiving cables 58 for controlling the pitch section 42 for movement in the pitch direction. Openings 60 are provided through plate 50 for receiving the distal yaw cables 62 (see FIG. 9). Plate 50 also includes openings 64 for receiving support cables 66 connecting plate 50 with the distal end plate 68 (FIG. 7) of the proximal yaw section, i.e., the proximal end plate 68 of the pitch section 42. The cables 66 connecting plates 50 and 68 are fixed to these end plates and maintain the proximal yaw section 46 in a beam configuration notwithstanding the required lateral flexibility of the proximal yaw section. The support cables 66 are anchored in plates 50 and 68. Opening 70 in plate 50 (FIG. 5) receives diagnostics and a hose line 72 for flowing fluid to the cleaning head 28.

Figure 8:
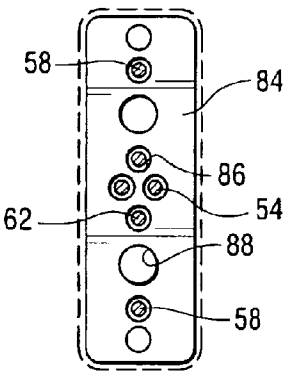
FIG. 8 is an end view of the distal end plate of the pitch section of the manipulator arm.
Figure 7:
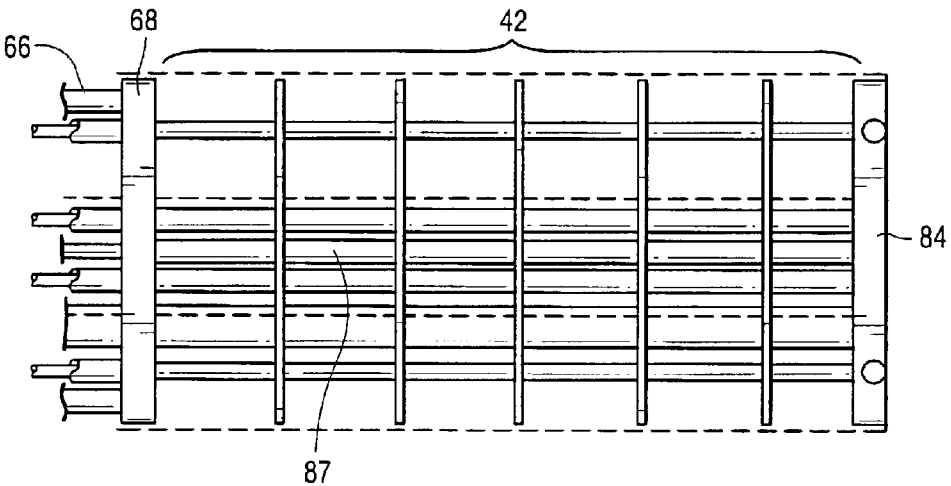
FIG. 7 is a fragmentary side elevational view illustrating the pitch section of the manipulator arm.
Figure 6:
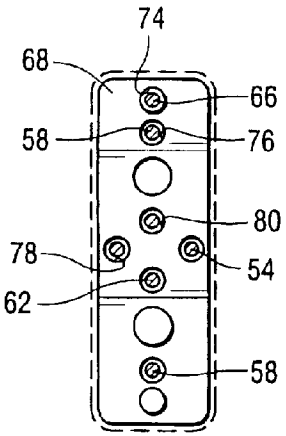
FIG. 6 is an end view of the proximal end plate at the beginning of the pitch section of the manipulator arm.

Referring to FIGS. 6–8, the proximal end plate 68 of the pitch section 42 includes openings 74 for anchoring the support cables 66, openings 76 for receiving the pitch control cables 58, openings 78 for receiving the proximal yaw control cables 54 and openings 80 for receiving the cables 62 for distal yaw control. Plate 68 also has an opening 82 for receiving the line 72. The proximal yaw section control cables 54 are anchored in plate 68.

Figure 10:
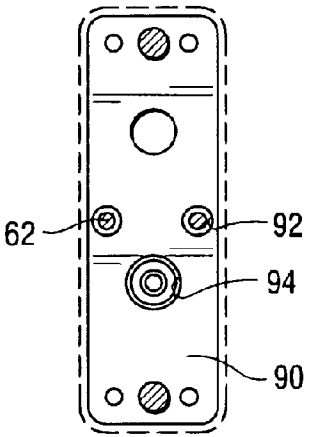
FIG. 10 is an end view of the distal plate of the distal yaw section to which the cleaning head is secured.

A distal end plate 84 is provided at the distal end of pitch section 42. As illustrated in FIG. 8, the pitch section control cables 58 are anchored in end plate 84. Yaw cables 62 pass through openings 86 in plate 84. Opening 88 receives the diagnostic and hose line 72. Additionally, support cables 87 are anchored in plates 68 and 84 to maintain pitch section 42 against lateral (yaw) movement while permitting movement in the pitch direction. As illustrated in FIG. 3, the distal yaw control cables 62 are rotated 90° for reception side-by-side in the distal yaw section 44. The distal end plate 90 (FIG. 10) of the distal yaw section 44 has openings 92 for anchoring the distal yaw control cables 62. End plate 90 also has an opening 94 for receiving the diagnostic and hose line 72. Opposite ends of cables 96 are anchored in plates 84 and 90 to maintain the distal yaw section 44 substantially inflexible in the pitch direction but flexible in the yaw direction, i.e., maintain the distal yaw section 44 in a beam configuration in the pitch direction.

To maintain the various plates of the proximal and distal yaw and pitch sections spaced from one another in the lengthwise direction of the manipulator arm 40, compliant material is located between the plates to provide varying degrees of flexibility of the arm 40. For example, and referring to FIG. 3, the pitch section 42 may be provided with blocks 57 formed of 40 Durometer urethane molded between each of the plates 59 in the central region of the pitch section 42. Thus, voids are left between the plates 59 along each of the outer extremities of the rectilinear spaces in pitch section 42. The compliance of this urethane material, its arrangement in the central region, and the voids on opposite outer extremities, enable substantial movement in a pitch direction, i.e., along a radius relative to the central axis of the compressor.

For the distal yaw section 44, the plates 61 of section 44 are spaced one from the other. Centrally located, laterally thin, blocks 63 of molded plastic material, i.e. preferably 60 Durometer urethane extend between plates 61 and along the long axis of the plates. The mold material thus extends along central regions of the plates 61 and, being thin in a lateral direction, enable flexing of the distal yaw section in a lateral direction.

The proximal yaw section 46 is similar to the distal yaw section 44 and has laterally wider molded blocks of similar plastic material between the adjacent plates 63 than the blocks 63 between plates 61 of the distal yaw section 44. Again, blocks of urethane material in combination with voids within the proximal yaw section 46 are used to provide the desired lateral flexing compliance for the proximal yaw section 46.

It will be appreciated that the compliance of each of the sections 42, 44 and 46 may be changed by altering the plastic material, its Durometer as well as the location of the plastic material and the location of the resulting voids in the manipulator arm. Finally the entire manipulator arm is encased within a thin envelope of a plastic material, i.e., preferably urethane.

It will be appreciated therefore that each of the proximal and distal yaw sections 46 and 44, respectively, and pitch section 42 may be flexed by tensioning the appropriate cables. For example, the proximal yaw section can be flexed laterally, i.e., in a yaw direction, by tensioning one of the cables 54 and releasing but maintaining the other cable 54 under tension to direct the proximal yaw section 46 in a selected lateral direction. Similarly, by tensioning one of the pitch section control cables 58, while maintaining the opposite pitch section control cable 58 under tension, the pitch section can be flexed in a pitch direction at right angles to the yaw direction, i.e., a generally radial direction when the compressor cleaning system is in use. Finally, the distal yaw section 44 can be displaced laterally by tensioning a distal yaw cable 62 and relieving the opposite cable 62, while maintaining it under tension. It will thus be appreciated that the selected movements of the cables 54, 58 and 62 may direct or steer the cleaning head 28 through the blading of the various stages as the cleaning head is inserted into or withdrawn from the compressor blading.

Figure 12:
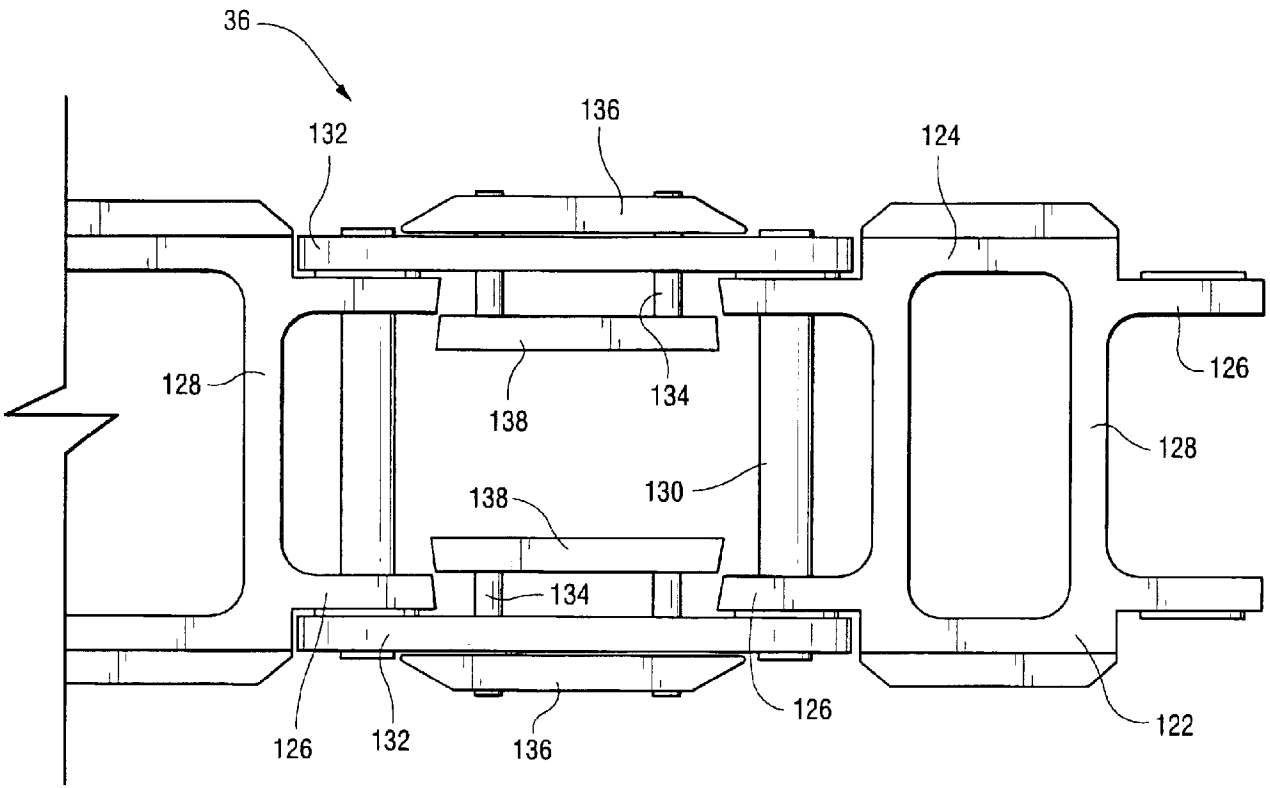
FIG. 12 is a fragmentary side elevational view of the deployment chain in an unlocked position.
Figure 13:
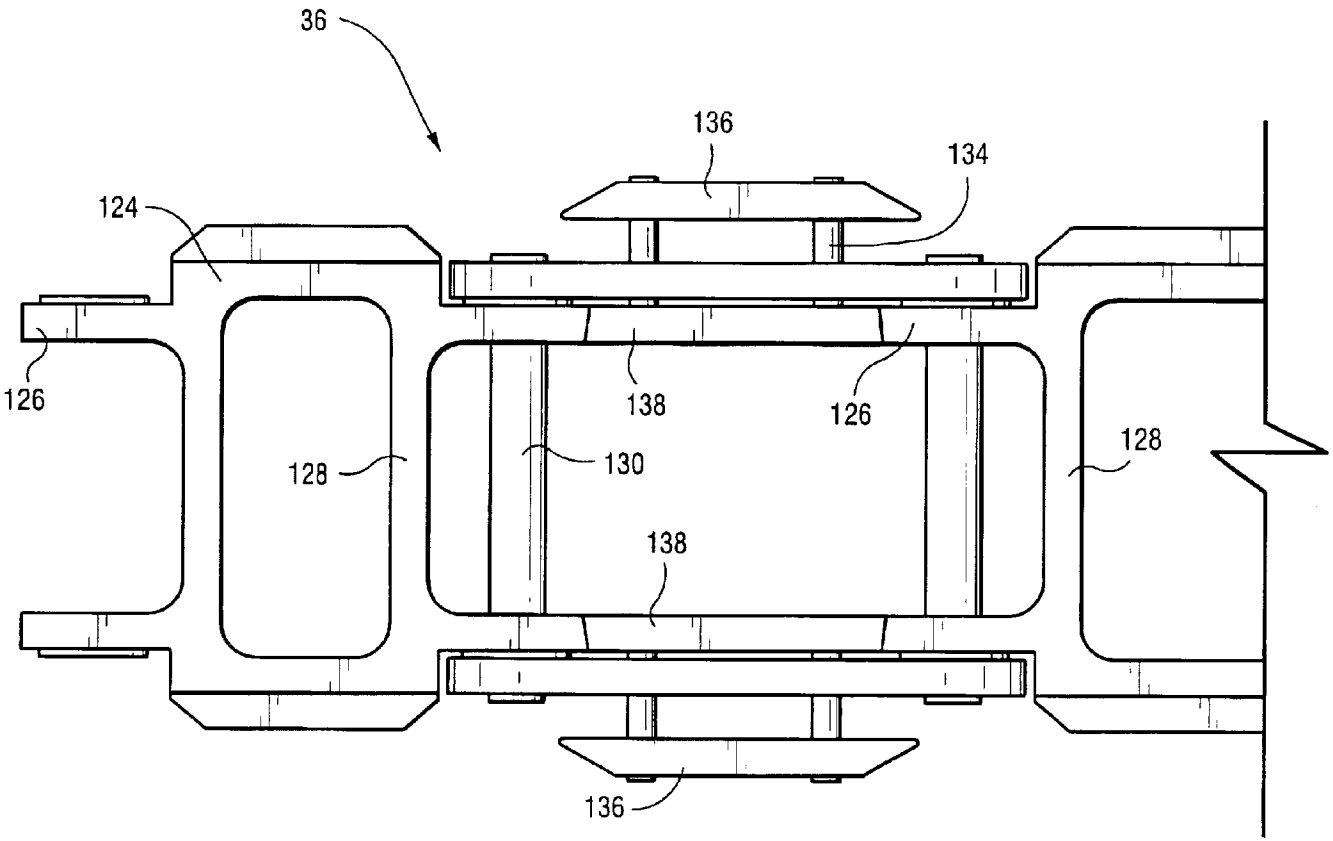
FIG. 13 is a view similar to FIG. 12 illustrating the deployment chain in a locked position.
Figure 14:
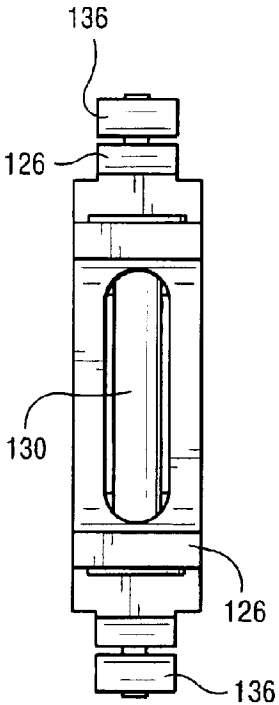
FIG. 14 is an end view of a deployment chain link.

As noted previously, a deployment chain 36 (FIGS. 11–14) is carried in guides in the insertion drive assembly 34. Additionally, the deployment chain 36 mounts at its distal end actuators for the steering cables, which actuators, in turn, carry the proximal end of the manipulator arm 40. Referring to FIGS. 11–14, the deployment chain 36 includes a plurality of fixed chain links 122 in the form of a rectilinear box-like main section 124 having spaced flanges 126 projecting from opposite end walls 128. The pair of flanges 126 on each of the opposite ends of each fixed link 122 have aligned openings for receiving axles 130. Pivotal links 132 each having openings at opposite ends for receiving the axles 130 overlie the flanges 126 along upper and lower surfaces, respectively, of the deployment chain. Each of the pivotal links 132 also has a pair of spaced openings for receiving pins 134 interconnecting a locking plate trigger 136 and a locking plate 138. As illustrated in FIG. 12, it will be appreciated that each of the locking plate triggers 136 are in a depressed configuration enabling the chain links 122 to pivot about the axles 130 in a lateral direction. With the locking trigger plate 136 and locking plate 138 displaced outwardly as illustrated in FIG. 13, the locking plates 138 are disposed between flanges 126. By disposing the locking plates 138 between the flanges of the fixed links 122, the chain is no longer capable of flexing in a lateral direction about the axles 130 and locks in a straight line configuration, forming a beam. The deployment chain in the locked beam configuration affords structural stiffness to withstand moment and torsional loads created by deployment forces, the weight of the manipulator arm 40 and chain and the reaction forces/moments from any contact of the arm with the compressor blades.

Figure 15:
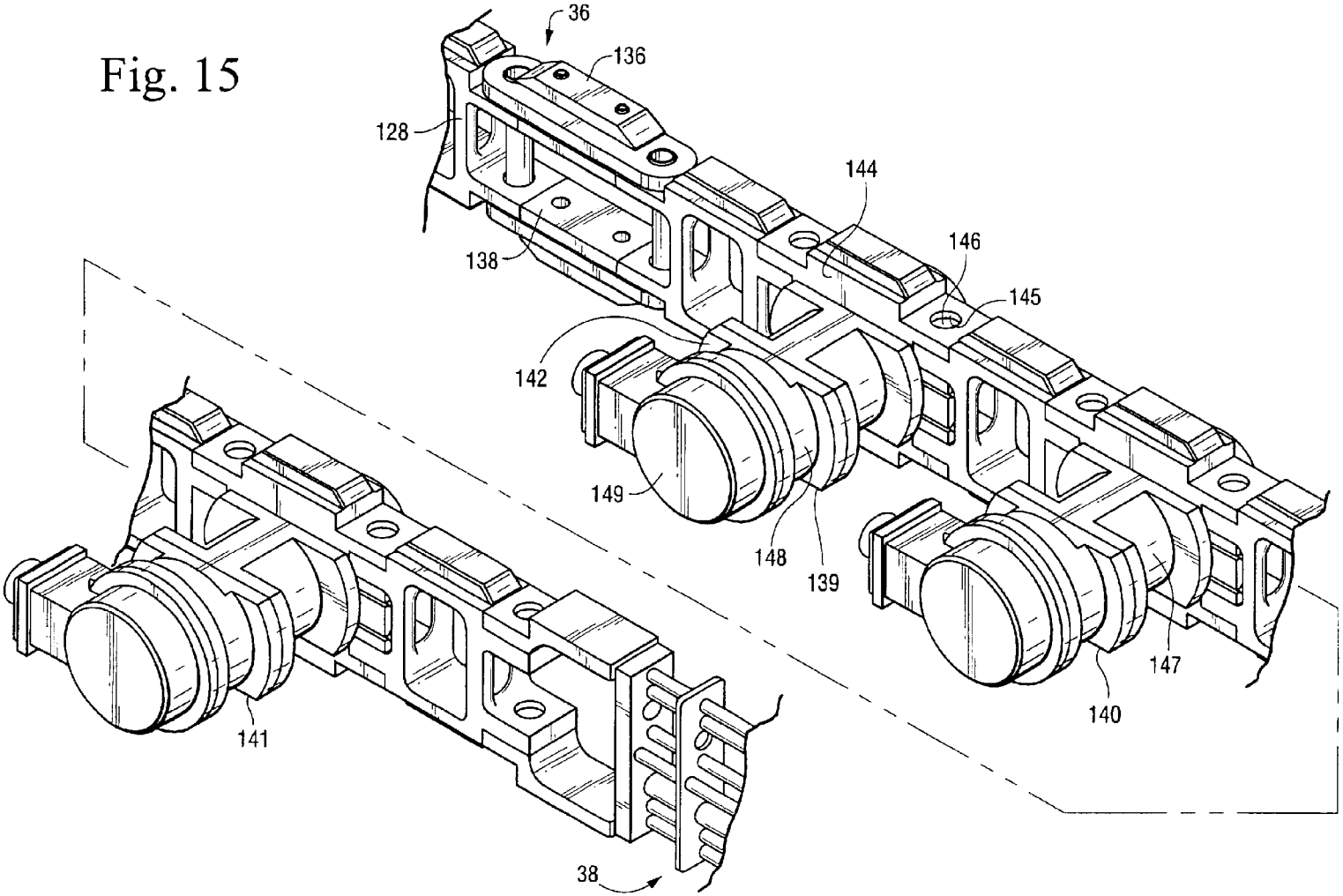
FIG. 15 is a perspective view illustrating actuators for manipulating the manipulator arm and cleaning head.

Referring now to FIG. 15, there is illustrated actuators 139, 140 and 141 for manipulating the manipulator arm 40. There is an actuator for each of the proximal, yaw and pitch sections of the manipulator arm 40 to respectively actuate the cables 54, 58 and 62 for steering the sections of the arm in the pitch and yaw directions. The actuators 139, 140 and 141 are disposed in series at the distal end of the deployment chain 36 and the proximal end of the manipulator arm 40. Each actuator includes an actuator body 142 having along one side portions of a chain link 144. The chain link portion 144 includes openings 145 to receive axles 146 whereby the actuator may be pivotally mounted to an adjoining actuator or the deployment chain or manipulator arm, as applicable. Projecting to one side of each actuator body 142 is a drum 147 driven by a motor 148 through a gear reduction, not shown. A pair of the manipulator arm steering cables are attached to opposite sides of the drum 147. In this manner, one steering cable, e.g., cables 54, is pulled in, while the second cable is paid out as the drum rotates. A position sensor 149 is rotationally connected to each drum and monitors the angular position of the drum, the position sensor being coupled to a compressor cleaning system controller C (FIG. 19). With the steering cable pairs for the respective proximal yaw, pitch and distal yaw sections coupled to the actuators, respectively, the manipulator arm 40 and, hence, the cleaning head 28, can be steered in directions at right angles to one another for weaving through the maze of blades to locate the cleaning head 28 adjacent a selected blade.

Circumferential Position Drive Assembly

Figure 16:
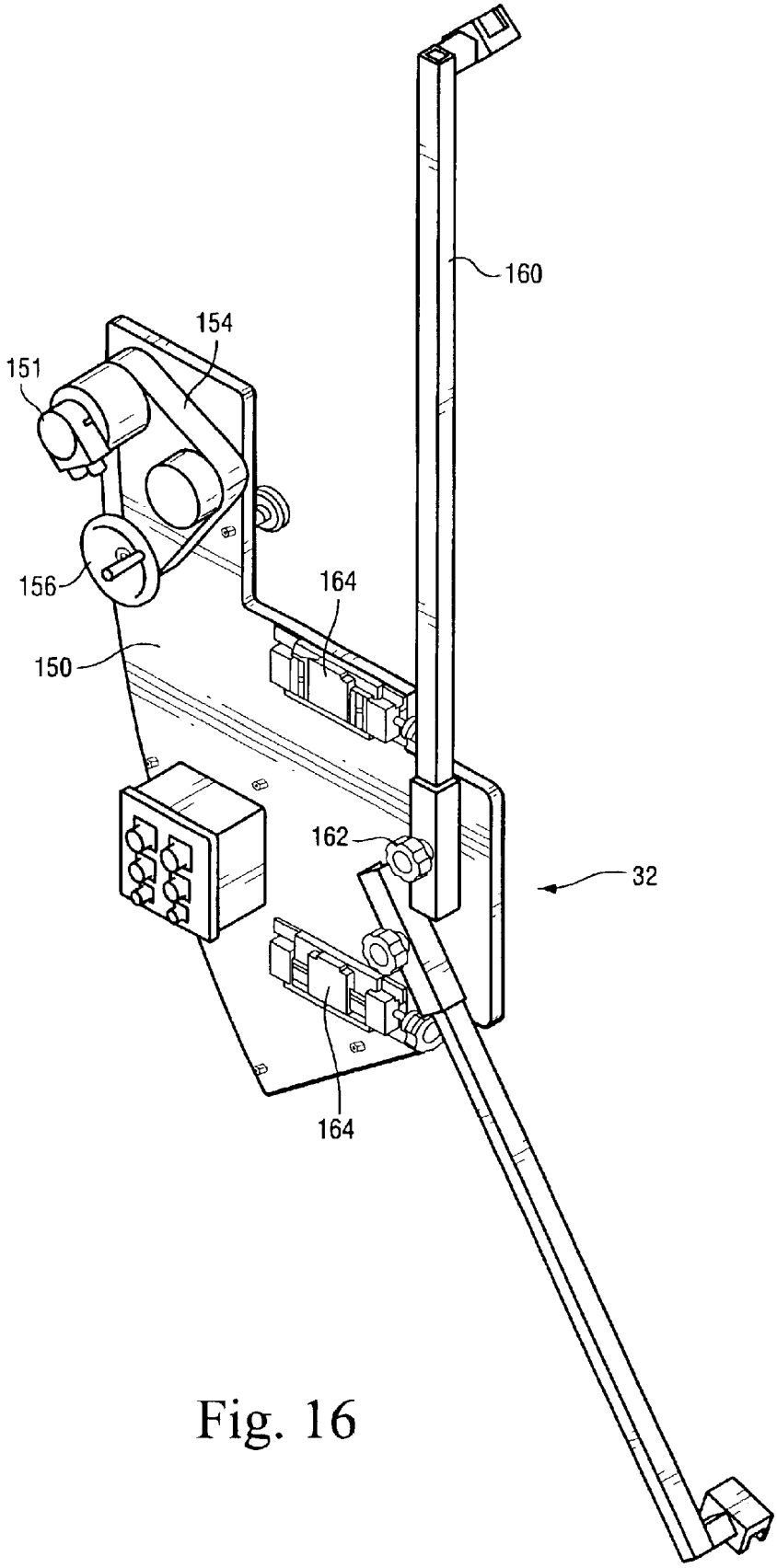
FIG. 16 is a perspective view illustrating a circumferential position drive assembly.
Figure 17:
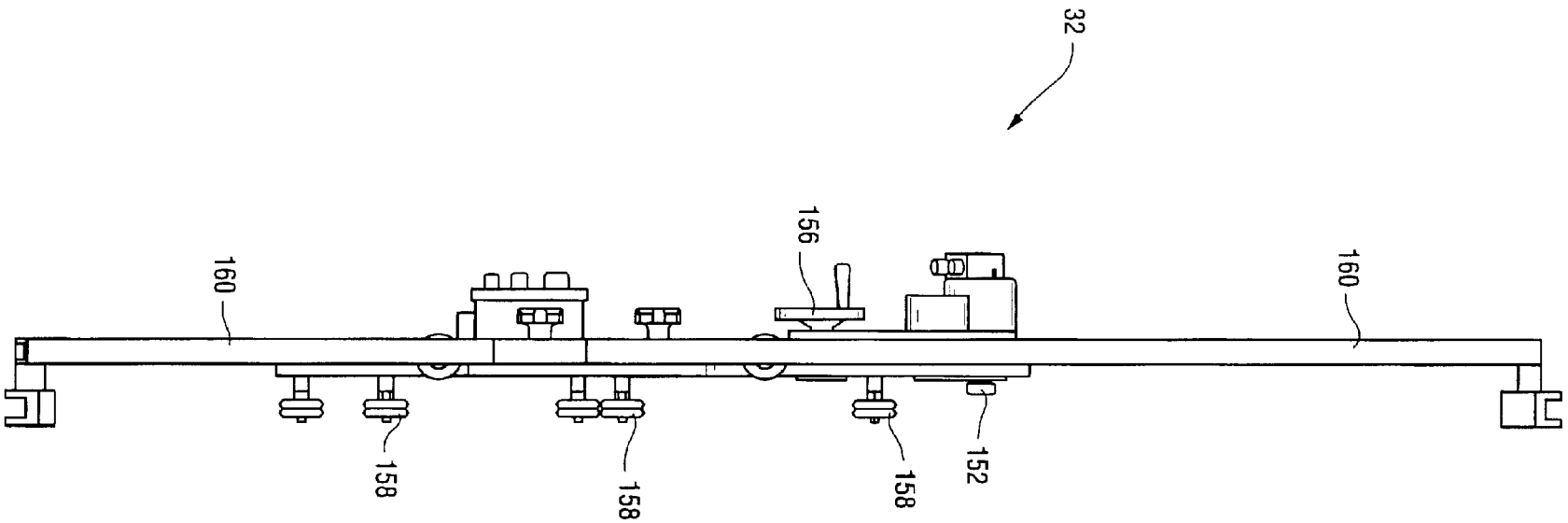
FIG. 17 is a side elevational view of the circumferential drive assembly of FIG. 16.
Figure 18:
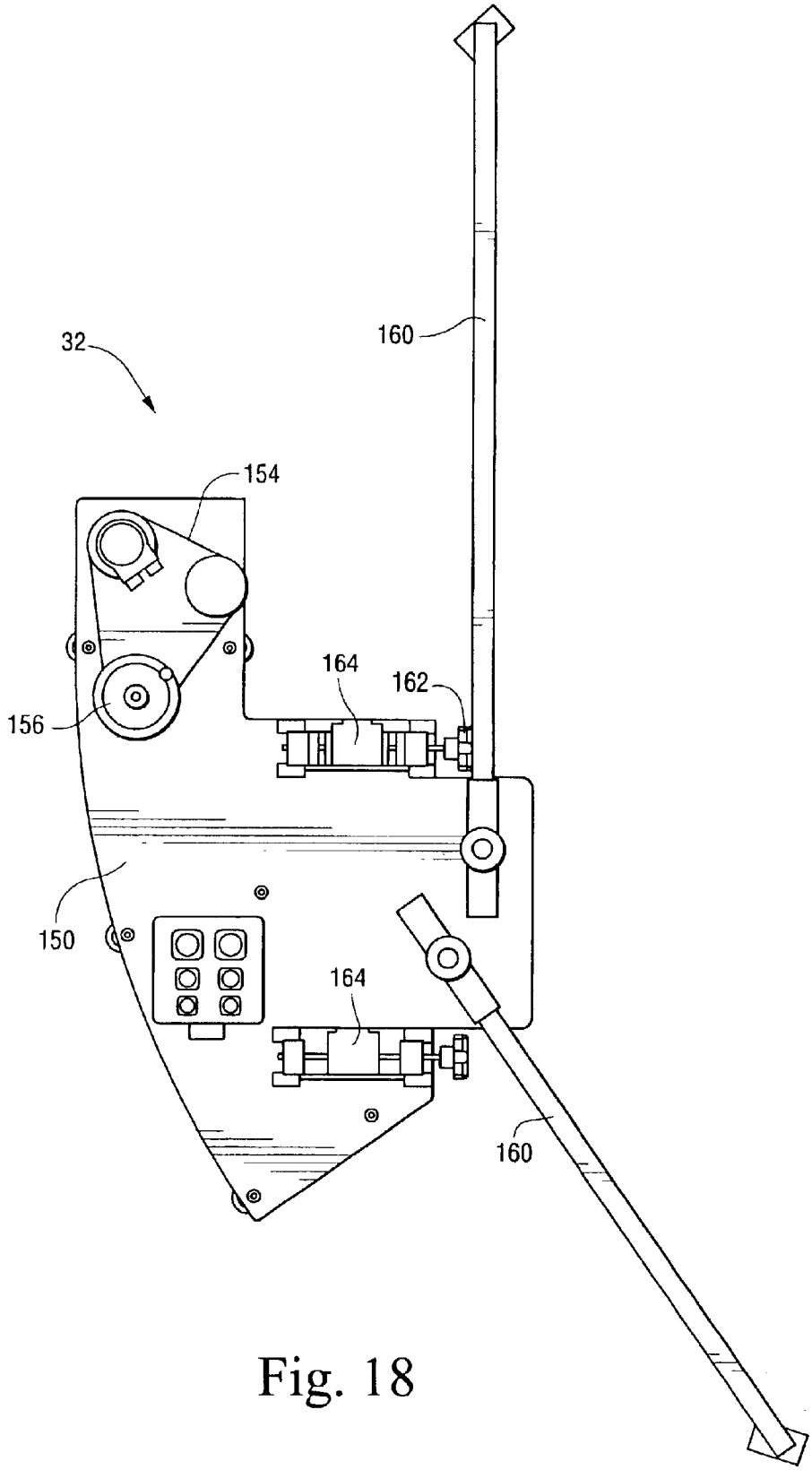
FIG. 18 is an elevational view of the circumferential position drive assembly.

Referring to FIG. 19, the circumferential position drive assembly 32 is mounted on the track assembly 30 for traversing 360° about the inlet of the compressor. The assembly 32 also mounts the insertion drive assembly 34 which carries the deployment chain 36 and the manipulator arm assembly 38. Particularly, the circumferential position drive assembly 32 includes a base plate 150 (FIGS. 16–18) on which is mounted a servomotor 151 which drives a pinion gear 152 (FIG. 17) on the opposite side of the plate for engaging a toothed track of the track assembly 30. A pulley assembly 154 engages a manual hand wheel 156 whereby the circumferential position assembly 32 can be manually traversed about the track assembly. Pairs of wheels 158 (FIG. 17) on the opposite side of base plate 148 from servomotor 150 engage inner and outer margins of the circular track to align the assembly 32 on the track. Outrigger legs 160 extend from the base plate 148 to the circular track, providing improved stability and load distribution for the insertion drive assembly 34, the deployment chain 36, and the manipulator arm assembly 38 carried by the circumferential position drive assembly 32. Wedge blocks 162 mounted on screw threads maintain the outrigger legs 160 in position, the outer ends of which are clamped onto the margins of the track. Mounting blocks 164 are mounted on the front face of base plate 148 and cooperate with complementary blocks on the insertion drive assembly 34 (FIG. 2) for mounting the latter to the circumferential position drive assembly 32.

Referring now to FIG. 19, there is illustrated the track assembly 30 comprising a plurality of arcuate track segments 166. The segments are provided with suitable latches at adjoining ends to secure the segments one to the other in the annular array thereof to form the full circular track. A gear track 170 is carried by the track for engagement by the pinion 152 of the circumferential position assembly 32. Straps 172 are provided at circumferentially spaced positions about the circular track to secure the track to the steering vanes of the compressor whereby the track lies in the bell mouth inlet to the compressor, substantially coaxially of the rotor axis. Guides 174 receive the leading edges of the steering vanes of the compressor.

Insertion Drive Assembly

The insertion drive assembly 34 aligns and guides the manipulator arm 40 and the deployment chain 36 into the compressor and forms a track about which the manipulator arm and deployment chain are contained and guided. Particularly, and referring to FIG. 2, the insertion drive assembly 34 includes opposed upper and lower guides 178 and 180 defining a guide channel 182 therebetween. The guide channel 182 extends along the front side of the assembly 34, about a chain canister 184 at one end of the assembly 34 and along the back side of the assembly 34. The opposite end of the guide channel 182 is directed toward and extends generally parallel to the axis of the compressor such that the cleaning head 28 and arm 40 can be inserted in a generally axial direction into the compressor blading. The movement of the manipulator arm and deployment chain through the guide is accomplished by friction between several endless belts positioned at the upper and lower corners of the guide channel in positions to engage the manipulator and chain assemblies when they are captured by the guide channels. A servomotor is secured to the guide plates to provide the motive force to rotate the guide pulleys of the endless belts thereby affording position control over the manipulator and chain assemblies. A handle is provided to the endless drive belt arrangement to provide manual adjustment of the axial position of the manipulator arm. A position sensor is frictionally coupled to the manipulator and chain and monitors the axial position of the manipulator and chain.

Referring back to FIG. 1, it will be seen that the insertion drive assembly 34 locates the exit point of the guide channel 182 so that the manipulator arm 40 follows a line that is generally coplanar with and at an angular relation to the axis of the turbine. Preferably, the manipulator arm follows a line 7° relative to and toward the compressor axis. Further, the insertion guide channel 182 is located such that the manipulator arm 40 is directed to intersect all of the blades of the first five compressor stages at about the radial midpoint of each blade set. It will be appreciated that the insertion drive assembly is releasably mounted onto the circumferential positioning assembly 32 by supports 190 thereof (FIG. 2) cooperable with the mounting blocks 164 at the circumferential position drive assembly 32. Also, the exit and entry of the insertion drive assembly 34 includes ramps which engage the trigger plates 136 of the deployment chain to convert the chain from its straight beam configuration extending toward the compressor blading into a laterally flexible chain which can wind about, i.e., follow the curved contours of the guide channel 182 of the insertion drive assembly 34. Conversely, cams located at the end of the insertion drive assembly engage the locking assembly to displace the locking plates 138 outwardly to convert the flexible chain to a straight beam configuration for insertion into the compressor blading.

To employ the robotic cleaning system hereof, the circular track assembly 30 is assembled and mounted by using straps 172 to the steering vanes at the compressor inlet. The circumferential position drive assembly 32 is then mounted on the track assembly 30. The insertion drive assembly 34 is then mounted on the circumferential position drive assembly 32. The manipulator arm assembly, as well as the chain, are installed with the insertion drive assembly 34. The system may then be operated manually or by computer control from a compressor mapping of the particular compressor whose blades are to be cleaned. Compressor mapping is accomplished by making several insertions of the manipulator arm 40 into the compressor at various circumferential positions about the compressor inlet to identify the rotor wheel arrangement. The manipulator insertion sensor on the insertion drive assembly measures the distance of manipulator insertion, while actuator control cable sensors measure the deflection of the cleaning head from its center position. This data is used to calculate the forward kinematics for the manipulator that forms the basis for locating the manipulator and compressor blades on the compressor map. Once mapping is completed, cleaning may commence.

The cleaning head 28 is inserted into the inlet of the compressor and the control cables are manipulated in accordance with the compressor map to weave the cleaning head between the blades and vanes. A camera and lighting on the cleaning head 28 is provided to assist the operator in centering the cleaning head in the space between the blades and vanes to achieve the best path through the compressor. The insertion sensor measures the distance of manipulator insertion. The actuator control cable sensors measure deflection of the cleaning head from its center position. This data is used to calculate the forward kinematics for the manipulator and reverse kinematics are calculated for retrieval of the cleaning head from within the blades. Preferably, the compressor blades and vanes are cleaned from the innermost locations toward the bell mouth. By supplying a high pressure water spray which will generally eclipse the entire blade/vane width, the blade is cleaned. However, by manipulating the arm in a pitch direction, the cleaning head may traverse the radial length of the blades to achieve complete coverage. It will be appreciated that forward and side-looking cameras are provided on the cleaning head for inspection of the blades during the cleaning process.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for cleaning compressor blades of a turbine in situ, comprising:

(a) inserting a cleaning head having a plurality of nozzles into a compressor through an inlet end thereof at a predetermined circumferential location about the compressor inlet to locate the cleaning head adjacent of one of a plurality of rotatable blades of the compressor;

(b) manipulating the cleaning head in pitch and yaw directions while inserting the cleaning head to locate the cleaning head in the compressor blades past first stage stator blades; and (c) actuating the cleaning head to clean the one rotatable blade of the compressor.

2. A method according to claim 1 including withdrawing the cleaning head away from the one compressor blade to a location forwardly of the first stage compressor blades, displacing the cleaning head in a generally circumferential direction about the inlet to the compressor to a second circumferential location thereabout and inserting the cleaning head into the compressor blades to locate the cleaning head adjacent a second rotatable blade of the compressor and actuating the cleaning head to clean the second compressor blade.

3. A method for cleaning compressor blades of a turbine in situ, comprising:

(a) providing an insertion assembly having a manipulator arm mounting a cleaning head having a plurality of nozzles on a distal end thereof;

(b) inserting the manipulator arm into a compressor through an inlet end thereof at a predetermined circumferential location about the compressor inlet;

(c) manipulating the arm in pitch and yaw directions while inserting the arm to locate the cleaning head in the compressor blades past first stage blades thereof; and (d) actuating the cleaning head to clean at least one compressor blade of the compressor.

4. A method according to claim 3 including withdrawing the cleaning head away from the one compressor blade to a location forwardly of the first stage compressor blades, displacing the insertion assembly in a generally circumferential direction about the inlet to the compressor to a second circumferential location thereabout and inserting the manipulator arm into the compressor blades to locate the cleaning head adjacent a second compressor blade and actuating the cleaning head to clean the second compressor blade.

5. A method according to claim 3 including mounting the manipulator arm to a flexible chain carried by a support adjacent the compressor inlet end.

6. A method according to claim 3 wherein step (c) includes flexing a portion of the manipulator arm in a yaw direction by tensioning cables passing through the manipulator arm.

7. A method according to claim 3 wherein step (c) includes flexing a portion of the manipulator arm in a pitch direction by tensioning cables passing through the manipulator arm.

8. A method according to claim 3 including displacing the insertion assembly in a generally circumferential direction about the compressor inlet end to locate the cleaning head in position to clean blades circumferentially spaced from the one compressor blade.

9. A method according to claim 3 including forming the manipulator arm into proximal and distal yaw sections with a pitch section intermediate the proximal and distal yaw sections and forming the yaw sections with different degrees of lateral flexing compliance.

10. A method according to claim 3 including providing a light and a camera on said manipulator arm for remote visualization of the one blade.

11. A method according to claim 5 including transforming the flexible chain to form a support beam for the manipulator arm as the manipulator arm is inserted into the compressor and transforming the support beam back into the flexible chain upon withdrawal of the manipulator arm from the compressor.

* * * * *